US008445799B2

(12) United States Patent
Lin

(10) Patent No.: US 8,445,799 B2
(45) Date of Patent: May 21, 2013

(54) WIPER CONTROL SWITCH

(75) Inventor: Jason Lin, Dublin, OH (US)

(73) Assignee: Honda Motor Co., Ltd., Tokyo (JP)

( * ) Notice: Subject to any disclaimer, the term of this patent is extended or adjusted under 35 U.S.C. 154(b) by 374 days.

(21) Appl. No.: 12/819,474

(22) Filed: Jun. 21, 2010

(65) Prior Publication Data

US 2011/0308922 A1 Dec. 22, 2011

(51) Int. Cl.
*H01H 9/00* (2006.01)
*H01H 3/16* (2006.01)

(52) U.S. Cl.
USPC ..... 200/61.27; 200/61.54

(58) Field of Classification Search
USPC ..... 200/64.54, 61.27, 336, 564; 74/527, 74/529–531
See application file for complete search history.

(56) References Cited

U.S. PATENT DOCUMENTS 4,387,279 A 6/1983 Brevick
4,849,585 A * 7/1989 Vidican et al. ..... 200/61.54
5,003,132 A 3/1991 Lagier
5,049,706 A 9/1991 DuRocher
5,581,058 A 12/1996 Javery et al.
5,861,593 A 1/1999 Wiersing et al.
D413,091 S 8/1999 DuRocher et al.
6,069,461 A 5/2000 Jaworski et al.
6,114,640 A 9/2000 Oddo et al.
6,236,180 B1 5/2001 Contos et al.
6,365,852 B1 * 4/2002 Leng et al. ..... 200/61.54
6,534,732 B2 3/2003 Karasik et al.
6,534,733 B2 3/2003 Schwartz et al.
6,617,534 B2 9/2003 Goff et al.
6,791,049 B2 9/2004 Yamazaki
2008/0061722 A1 3/2008 Hasenberg et al.

OTHER PUBLICATIONS

Haptic Steering Wheel Switch, 2010 International CES, Jan. 7, 2010.

* cited by examiner

*Primary Examiner* — Briggitte R Hammond
(74) *Attorney, Agent, or Firm* — Fay Sharpe LLP

(57) ABSTRACT

A control switch for an associated vehicle has a control configured to selectively adjust operation of a predetermined vehicle function. The control is configured to rotate in a first direction a first rotational displacement to a first position. The predetermined vehicle function has a first operation through the first rotational displacement. The control is configured to rotate in the first direction a second rotational displacement larger than the first rotational displacement from the first position to a second position. The predetermined vehicle function has a second operation through the second rotational displacement.

21 Claims, 5 Drawing Sheets

WIPER CONTROL SWITCH

BACKGROUND

Exemplary embodiments herein generally relate to a control switch which can be mounted on a vehicle steering column for selectively actuating and controlling a vehicle function.

Automobiles commonly provide one or more control switches mounted on the steering column for controlling turn signals, headlights and/or windshield wipers. A known multifunctional control switch or wiper lever assembly is schematically illustrated in FIG. 1. The windshield wiper control switch 100 includes a handle 102 which can be displaced to initiate a plurality of wiper functions, such as setting various wiper speed settings. More particularly, the handle 102 can be moved between an off position, and several windshield wiper actuating positions including a low speed position, a high speed position and an intermittent or delay position at which the windshield wipers operate intermittently but at a variable rate. The handle 102 can be also be moved from the off position to a mist position which provides low speed operation of the windshield wipers only while held in that position. Also, the driver can actuate a windshield wash function by pulling the handle 102 to an operating position, from which position it is spring-biased back to off, so that the wash function only operates when the control switch is positively held in that position.

This known wiper control switch 100 can also include a rotatable operating control 110 on the outer end of the handle 102 which can selectively control the variable rate of the wipers in the intermittent position. The variable rate depends upon the rotational position of the control 110. The control has multiple rotational positions, with the various rotational positions being indicated as various indicia 112 are brought into registry with a marker 114. Rotation of the control 110 throughout a continuum of delay positions causes the period between actuations of the windshield wiper to vary.

Since, in many instances, the driver will be operating the windshield wipers and the washer system in bad driving conditions, an important feature of the multifunction control switch is that it be fully operable with one hand and without requiring the driver to observe the control switch. Therefore, the known wiper control switch 100 provides tactile feedback to the driver to inform the driver when a particular wiper speed or rate has been set. For example, as shown in FIGS. 2 and 3, the control switch 100 includes a selector assembly 120 for providing tactile feedback. The selector assembly includes a non-movable member 122 and a movable member 124 coupled to the control 110 for rotation therewith. The member 122 includes a pair of diametrically spaced projections 126 which are aligned with the marker 114. The member 124 includes a plurality of evenly spaced detents or ridges 130. With this arrangement, when the driver turns the control 110 clockwise or counterclockwise the detents 130 engage the projections 126 and the driver feels a tactile "click". While the known wiper lever assembly provides adequate tactile feedback to the driver, the "clicks" are equally spaced, which can still require the driver to look at the switch control switch 100 in order to determine the intermittent rate of the wipers and which direction increases the wiper rate and which direction decreases the wiper rate.

BRIEF DESCRIPTION

According to one aspect, a control switch for an associated vehicle comprises a a control operatively mounted to a vehicle steering column and configured to selectively adjust operation of a predetermined vehicle function. The control is configured to rotate in a first direction a first rotational displacement to a first position. The predetermined vehicle function has a first operation through the first rotational displacement. The control is configured to rotate in the first direction a second rotational displacement larger than the first rotational displacement from the first position to a second position. The predetermined vehicle function has a second operation through the second rotational displacement.

According to another aspect, a control switch for controlling wiper functions of an associated vehicle comprises a control operatively mounted to a vehicle steering column and rotatable about a longitudinal axis defined by the handle to selectively adjust operation of a predetermined function of the windshield wipers. The control includes at least three rotational displacements having different lengths. The length of each rotational displacement corresponds to an operation of the windshield wipers. A selector assembly is operatively associated with the control and is configured to provide tactile feedback to a driver of the rotation of the control through the differing rotational displacements.

According to yet another aspect, a method of controlling windshield wipers of an associated vehicle comprises providing a control. The control is rotatable to selectively adjust operation of a predetermined function of the windshield wipers. The control has a first rotational displacement and a second rotational displacement larger than the first rotational displacement. Each rotational displacement is operatively associated with an operation of the windshield wiper. The operation of the windshield wipers is constant through each of the first and second rotational displacements and the length of each rotational displacement corresponds to the operation of the windshield wipers. A tactile feedback is provided to a driver of the rotation of the control through the first and second rotational displacements.

DETAILED DESCRIPTION

Figure 1:
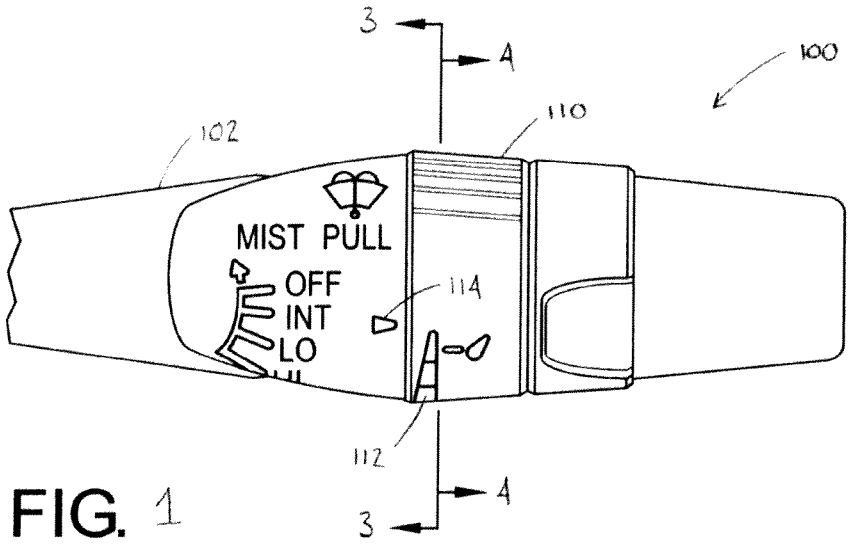
FIG. 1 (PRIOR ART)
FIG. 1 is a front schematic view of a known multifunction wiper control control switch.
Figure 2:
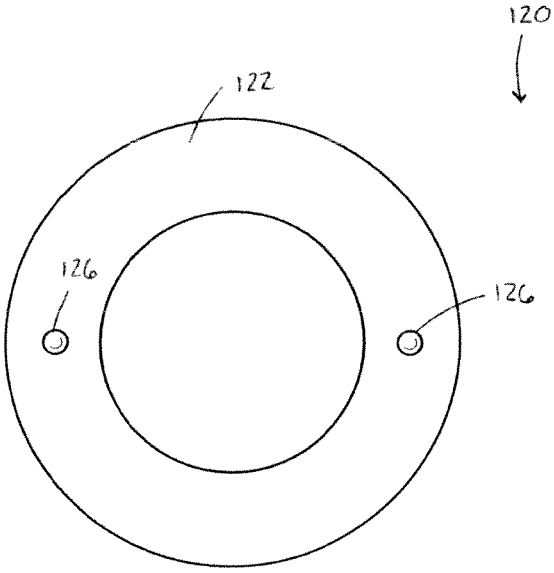
FIG. 2 (PRIOR ART)
FIG. 2 is a schematic view of a portion of a known selector assembly of the wiper control control switch of FIG. 1 taken generally along line 2-2 of FIG. 1.
Figure 3:
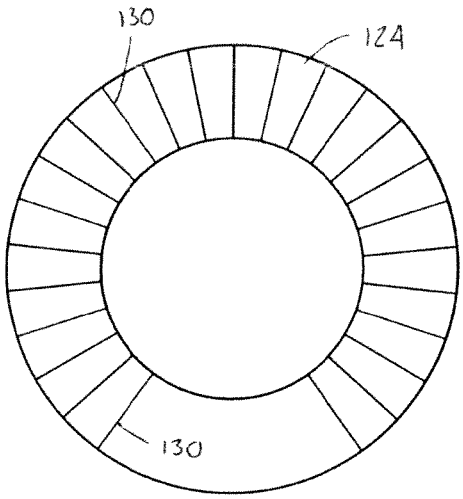
FIG. 3 (PRIOR ART)
FIG. 3 is a schematic view of a portion of the known selector assembly taken generally along line 3-3 of FIG. 1.
Figure 4:
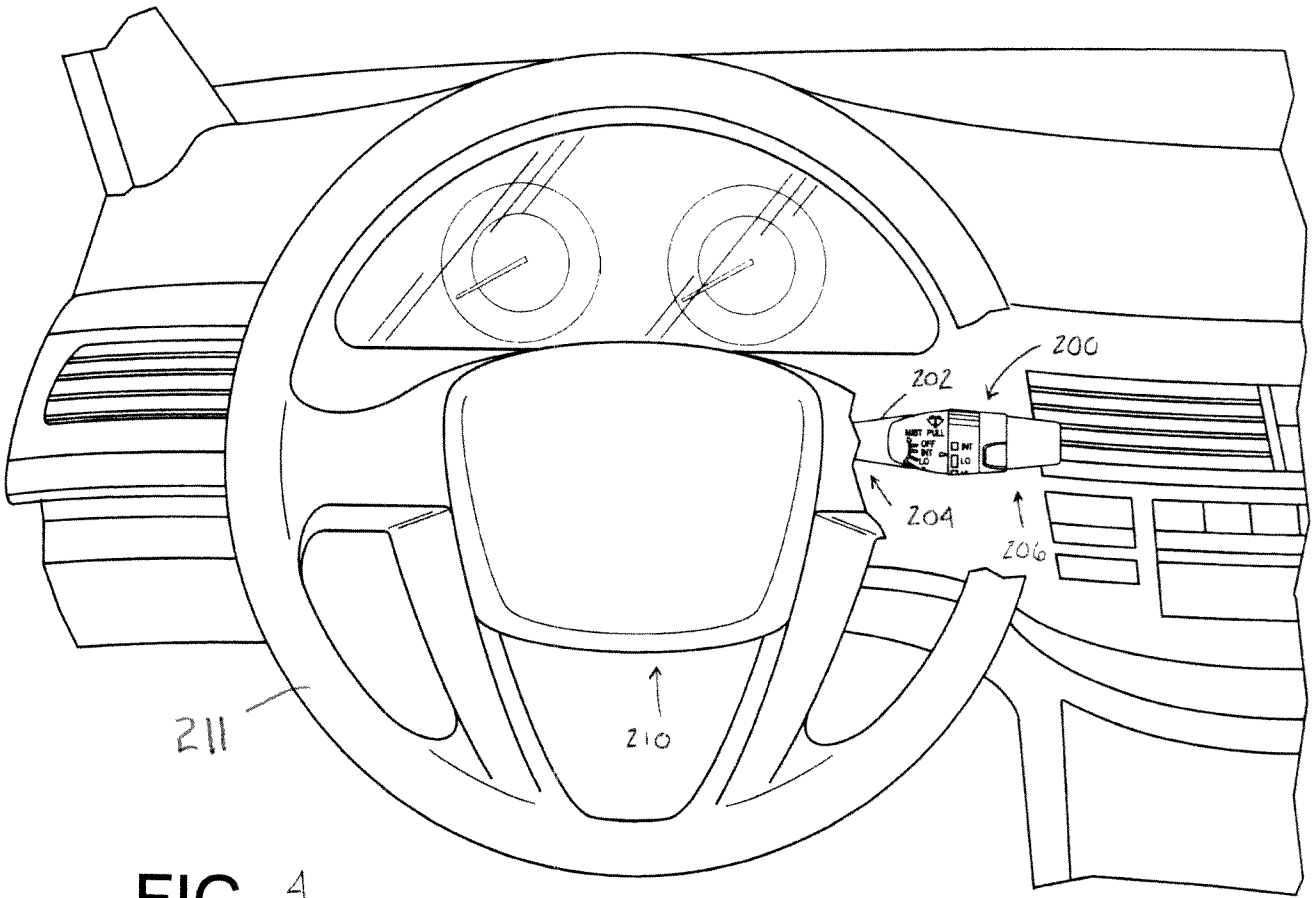
FIG. 4 is a schematic view of a wiper control control switch according to one aspect of the present disclosure mounted on a vehicle steering column.
Figure 5:
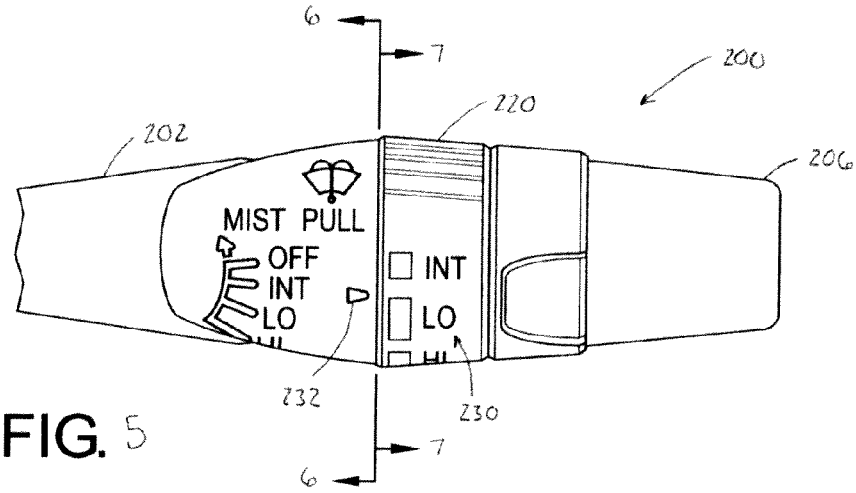
FIG. 5 is a front schematic view of the wiper control control switch of FIG. 4.

It should, of course, be understood that the description and drawings herein are merely illustrative and that various modifications and changes can be made in the structures disclosed without departing from the present disclosure. Referring now to the drawings, wherein like numerals refer to like parts throughout the several views, FIGS. 4 and 5 schematically depict a multifunction control switch or wiper lever assembly 200 according to one exemplary embodiment of the present disclosure. The multifunction control switch 200 generally comprises a handle 202 having a first end portion 204 and a second end portion 206. The first end portion 104 is operatively mounted to a vehicle steering column 210 including a steering wheel 211 mounted on a shaft (not shown). A control 220 is operably disposed on the second end portion 106 of the handle 102 to selectively adjust operation of a predetermined vehicle function, such as the depicted wiper functions.

Figure 7:
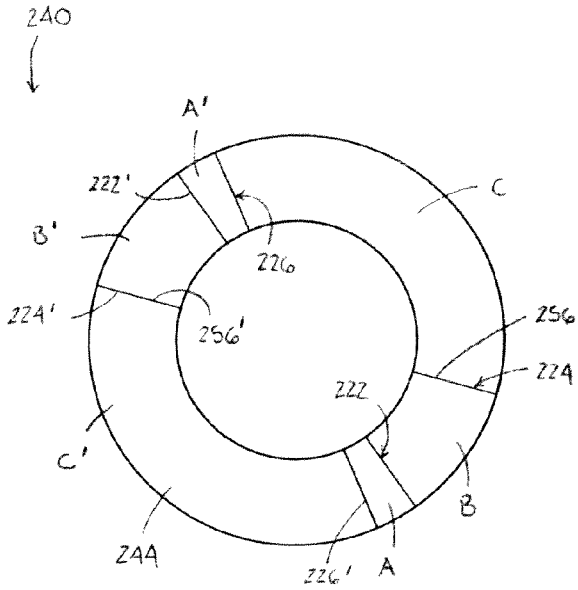
FIG. 7 is a schematic view of a portion of a selector assembly of the wiper control control switch of FIG. 5 taken generally along line 7-7 of FIG. 5.

As will be discussed in greater detail below, and according to one aspect, the control 220 includes at least two rotational displacements having differing lengths. The length of each rotational displacement corresponds to an operation of the windshield wipers. More particularly, the control 220 is configured to rotate in a first direction a first rotational displacement A (FIG. 7) to a first position 222 and rotate in the first direction a second rotational displacement B (FIG. 7) larger than the first rotational displacement from the first position to a second position 224. The predetermined vehicle function has a first operation through the first rotational displacement A and a second operation through the second rotational displacement B. According to another aspect, the control 220 includes a third rotational position 226 (FIG. 7). The control is configured to rotate in the first direction a third rotational displacement C larger than the second rotational displacement B from the second position 224 to the third position 226. The predetermined vehicle function has a third operation through the third rotational displacement C. Each of the first, second and third operations remains constant as the control 220 rotates through the respective first, second and third rotational displacements A, B, C.

The windshield wiper control switch 200 can be moved between an off position, and several windshield wiper actuating positions including a low speed position, a high speed position, and an intermittent or delay position at which the windshield wipers operate intermittently but at a variable rate. The handle 202 can be also be moved from the off position to a mist position which provides low speed operation of the windshield wipers only while held in that position. Also, the driver can actuate a windshield wash function by pulling the handle 202 to an operating position, from which position it is spring-biased back to off, so that the wash function only operates when the control switch is positively held in that position. Function graphics indicate the various functions of the control switch 200.

The rotatable operating control 220 selectively controls the variable rate of the wipers in the intermittent position. The variable rate depends upon the rotational position of the control 220. The control 220 manually rotates clockwise and counterclockwise about a longitudinal axis defined by the handle 202. As indicated above, the control 220 has multiple rotational positions 222, 224, 226, with the rotational positions being indicated as various indicia 230 are brought into registry with a marker 232. Rotation of the control 220 throughout the continuum of delay positions causes are of the period between actuations of the windshield wipers to vary and the speed of the windshield wipers to vary. It should be appreciated that the control 220 can have any desired outer shape, which is preferably ergonomically compatible with the driver's use of a single hand to operate the control. That is, the control 220 can includes flats, ridges or other types of configurations which aid the driver's fingers in gripping and rotating the control to a desired position.

Figure 6:
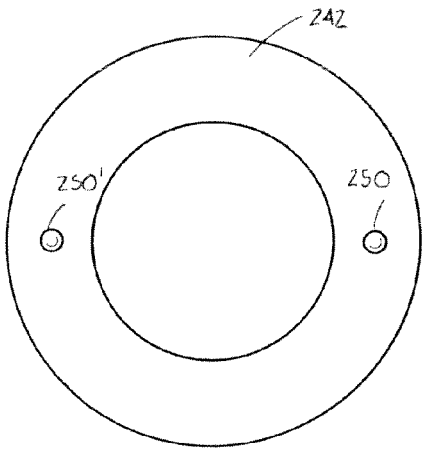
FIG. 6 is a schematic view of a portion of a selector assembly of the wiper control control switch of FIG. 5 taken generally along line 6-6 of FIG. 5.

As indicated previously, the control switch 200 must have the ability to provide tactile feedback to the driver to inform the driver when a particular wiper operation has been set. To this end, the first rotational displacement A of the control 220 provides a first tactile feedback to the driver indicative of the first operation of the predetermined vehicle function. The second rotational displacement B of the control 220 provides a second tactile feedback to the driver indicative of the second operation of the predetermined vehicle function. The third rotational displacement C provides a third tactile feedback to the driver indicative of the third operation of the predetermined vehicle function. Particularly, as shown in FIGS. 6 and 7, the switch control switch 100 includes a selector assembly 240 operatively associated with the control 220 and configured to provide tactile feedback to the driver of the rotation of the control 220 through the differing rotational displacements A, B, C. The selector assembly includes a non-movable, static first member 242 and a second member 244 coupled to the control 220 for rotation therewith. The second member 244 at least partially defines the rotational displacements A, B, C. The first member 242 engages the second member 244 at each rotational position 222, 224, 226 of the control 220.

The first member 244 includes at least one projection 250 which is aligned with the marker 224. The second member 244 includes a detent or ridge 256 positioned between each rotational displacement such that the detents at least partially define each of the first, second and third positions 222, 224, 226. In the depicted embodiment, the first member 244 includes a pair of diametrically spaced projections 250, 250' and the second member includes a first set of rotational displacements A, B, C and a second set of rotational displacements A', B', C'. Each of the rotational displacement A, B, C is diametrically spaced from each of the rotational displacements A', B', C'. With this arrangement, when the driver turns the control 220 clockwise or counterclockwise, the detents 256, 256' engage projections 250, 250' at each rotational position and the driver feels a tactile "click". Because the "clicks" are not equally spaced, there is no need for the driver to look at the control switch 200 in order to determine the intermittent rate of the wipers and which direction increases the wiper rate and which direction decreases the wiper rate.

For example, according to one aspect, rotation of the control 220 controls windshield wiper speed. The windshield wipers have a first speed through the first rotational displacement A, a second speed through the second rotational displacement B and a third speed through the third rotational displacement C. Each of the first, second and third rotational displacements of the control 220 corresponds to the speed of the windshield wipers, the longer the rotational displacement the faster the speed of the wipers. Thus, as the driver rotates the control 220, the driver can determine the speed by the length of the rotational displacement between the tactile "clicks." According to another aspect, rotation of the control 220 causes the windshield wipers to operate in an intermittent, delay action manner. The windshield wipers have a first delay through the first rotational displacement A, a second delay through the second rotational displacement B and a third delay through the third rotational displacement C. The rotational displacement of the control 220 corresponds to the period of delay of the wipers, the longer the rotational displacement the shorter the period between actuations of the windshield wiper. Again, the driver is able to determine the delay of the wipers by the length of the rotational displacement without having to look at the control switch 200.

Figure 8:
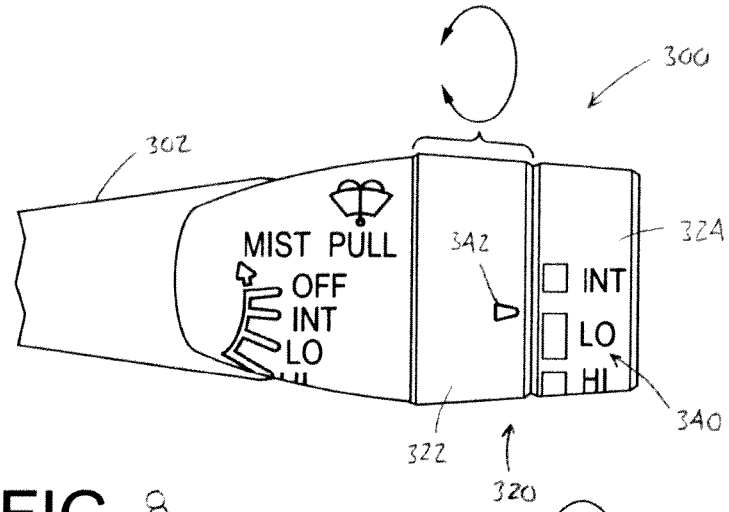
FIG. 8 is a front schematic view of a wiper control control switch according to another aspect of the present disclosure.
Figure 9:
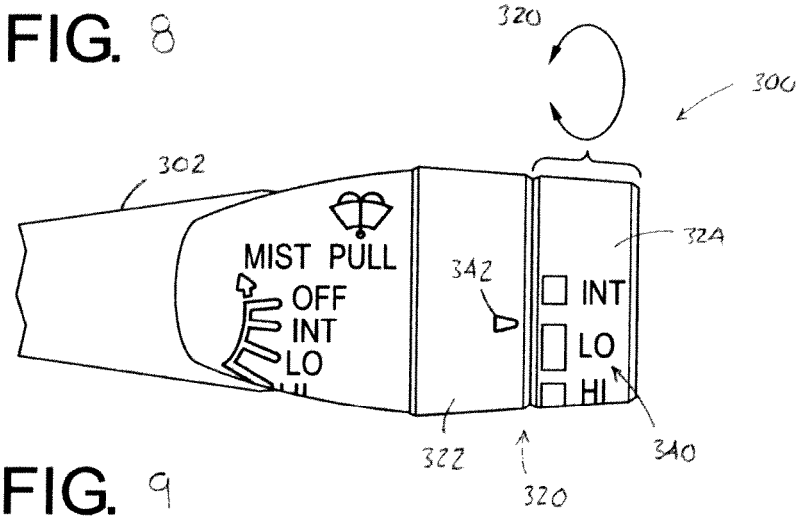
FIG. 9 is a front schematic view of a wiper control control switch according to yet another aspect of the present disclosure.
Figure 10:
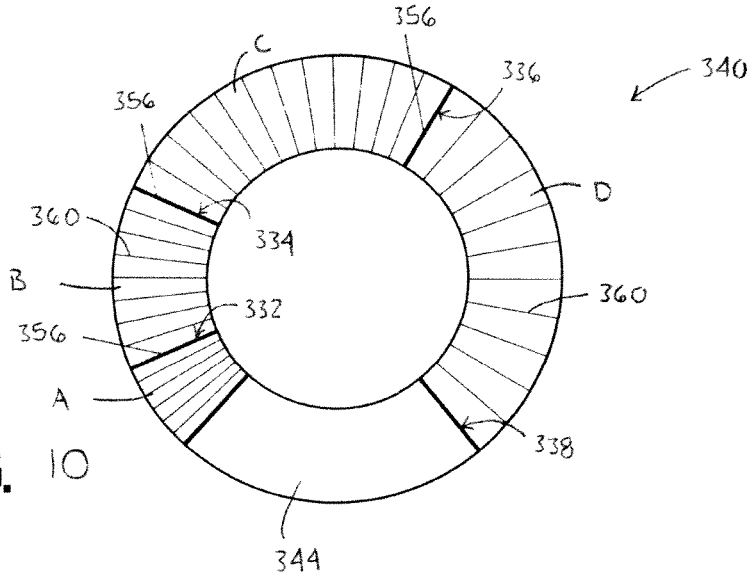
FIG. 10 is a schematic view of a portion of a selector assembly of the wiper control control switch of FIGS. 8 and 9.

With reference to FIGS. 8 and 9, a multifunction control switch 300 according to another exemplary embodiment is schematically illustrated. Similar to the multifunction control switch 200, multifunction control switch 300 generally comprises a handle 302 and a control 320 operably disposed on the handle. The control 320 includes a first portion 322 and a second portion 324, one of the first and second portions being rotatable to selectively adjust operation of a predetermined vehicle function, such as the depicted wiper functions. As shown in FIG. 10, the control 220 has multiple rotational positions 332, 334, 336, 338 with the various rotational positions being indicated as various indicia 340 located on the second portion 324 are brought into registry with a marker 342 located on the first portion 322. Rotation of control 220 throughout the continuum of delay positions causes the period between actuations of the windshield wipers to vary or the speed of the windshield wipers to vary.

A selector assembly 340 is operatively associated with the control 320 and is configured to provide tactile feedback to the driver of the rotation of the control between the rotational positions 332, 334, 336, 338. The selector assembly 340 includes a first static member (not shown, similar to first member 242 described above except only one projection is provided) and a second member 344 rotatable with one of the first and second portions 322, 324 of the control 320. With particular reference to FIG. 10, the control 320 includes four rotational displacements A, B, C, D of differing lengths, the length of each rotational displacement corresponding to an operation of the windshield wipers. A first detent or ridge 356 is positioned at each of the first, second, third and fourth rotational positions 322, 324, 326, 328. The second member 344 also includes a plurality of spaced apart second detents or ridges 360 located between the first detents 356. The second detents have a first spacing through the first rotational displacement A, a second spacing larger than the first spacing through the second rotational displacement B, a third spacing larger than the second spacing through the third rotational displacement D and a fourth spacing larger than the third spacing through the fourth rotational displacement D. With this arrangement, when the driver turns the control 320 clockwise or counterclockwise, the detents 356 engage the projection of the first member at each rotational position 322, 324, 326, 328 and the driver feels a first tactile "click." As the control rotates through the rotational displacements A, B, C, D, the detents 360 engage the projection of the first member (not shown) and the driver feels a second tactile "click." Because the first tactile "clicks" are not equally spaced and the second tactile "clicks" have different spacings through the rotational displacements A, B, C, D, there is no need for the driver to look at the control switch 300 in order to determine the intermittent rate of the wipers and which direction increases the wiper rate and which direction decreases the wiper rate.

Also provided is a method of controlling windshield wipers of an associated vehicle. A control 220, 320 is rotatable to selectively adjust operation of a predetermined function of the windshield wipers. The control 220, 320 has a first rotational displacement A and a second rotational displacement B larger than the first rotational displacement. Each rotational displacement A, B is operatively associated with an operation of the windshield wiper. The operation of the windshield wipers is constant through each of the first and second rotational displacements A, B and the length of each rotational displacement corresponds to the operation of the windshield wipers. A tactile feedback is provided to a driver of the rotation of the control 220, 320 through the first and second rotational displacements A, B.

The wiper control 220, 320 has longer distance "clicks" to indicate faster wiping speed. Different click intervals on the wiper control switch 200, 300 are used to correlate to the speed of the wipers. Rather than having all clicks spaced equally, there can be a longer (or shorter) travel distance between clicks to indicate a faster or slower wiping speed. This allows the driver to determine increased/decreased wiper speed by feel rather than by visual interpretation of indicator graphics.

Figure 11:
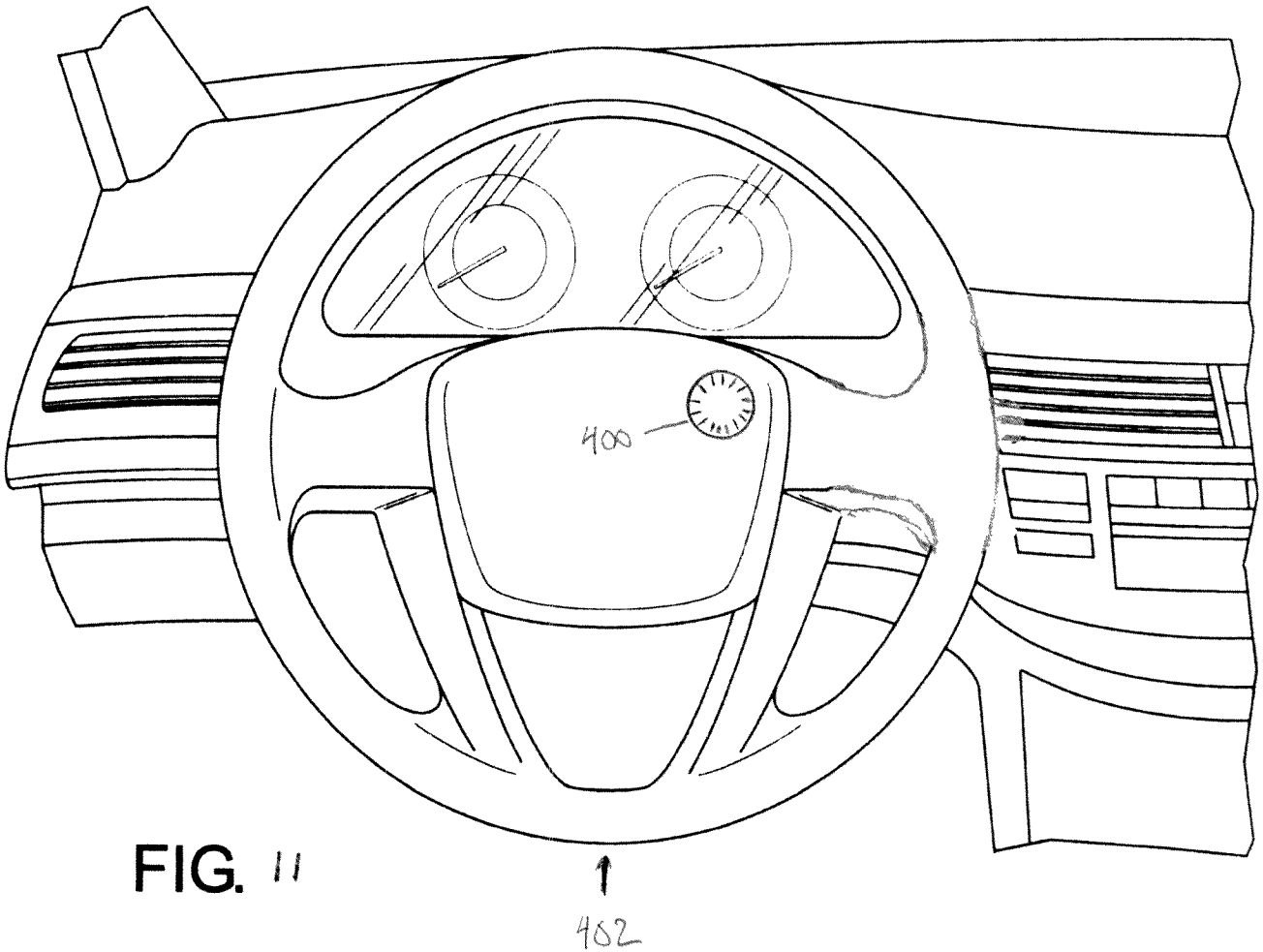
FIG. 11 is a front schematic view of a steering wheel including a multifunctional haptic control module.

Referring now to FIG. 11, a haptic control module 400 resides on the steering wheel 402. The haptic control module has the ability to control multiple elements of a vehicle which can include audio systems, communication systems, environmental systems, navigation systems and windshield wipers. The haptic control module has different tactile conditions so the vehicle operator can determine what vehicle system is being controlled by the type of feeling the module returns upon rotation. For example, the module can provide the following varied feelings: normal detents, deep detents, narrow detents, varied detents, vibration, and increasing resistance. Each would be associated with a vehicle system being controlled The use of detents having the incremental spacing described above to indicate increasing or decreasing wiper speed could similarly be provided.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A control switch for an associated vehicle comprising:

a control operatively mounted to a vehicle steering column, the control being configured to selectively adjust operation of a predetermined vehicle function, the control being configured to rotate in a first direction a first rotational displacement to a first position, the predetermined vehicle function having a first operation through the first rotational displacement, the control being configured to rotate in the first direction a second rotational displacement larger than the first rotational displacement from the first position to a second position, the predetermined vehicle function having a second operation through the second rotational displacement, and further comprising a selector assembly including a first static member and a second rotatable member rotatable with the control, the selector assembly operatively associated with the control and configured to provide tactile feedback to the driver of the rotation of the control from the first position to the second position by the first member engaging the second member at each rotational position.

2. The control switch of claim 1, wherein the first member includes a pair of diametrically spaced projections and the second member includes a pair of diametrically spaced first rotational displacement and second rotational displacements.

3. The switch of claim 1 residing on a handle extending from said steering column.

4. The control switch of claim 1, wherein the first rotational displacement provides a first tactile feedback to the driver indicative of the first operation of the predetermined vehicle function.

5. The control switch of claim 4, wherein the second rotational displacement provides a second tactile feedback to the driver indicative of the second operation of the predetermined vehicle function.

6. The control switch of claim 5, further comprising a third rotational position, the control being configured to rotate in the first direction a third rotational displacement larger than the second rotational displacement from the second position to the third position, the predetermined vehicle function having a third operation through the third rotational displacement.

7. The control switch of claim 6, wherein the third rotational displacement provides a third tactile feedback to the driver indicative of the third operation of the predetermined vehicle function.

8. The control switch of claim 1, wherein the first member includes a projection and the second member includes a detent positioned at each of the first and second positions, the projection engaging the detents as the control rotates.

9. The control switch of claim 8, wherein the second member includes a plurality of spaced apart second detents located between the detents, the second detents having a first spacing through the first rotational displacement and a second spacing through the second rotational displacement.

10. The control switch of claim 1, wherein the switch control switch controls wiper functions of the associated vehicle, rotation of the control controlling windshield wiper speed, the windshield wipers having a first speed through the first rotational displacement, the windshield wipers having a second speed through the second rotational displacement.

11. The control switch of claim 10, wherein each of the first and second rotational displacements of the control corresponds to the speed of the windshield wipers, the longer the rotational displacement the faster the speed of the wipers.

12. The switch of claim 10 comprising a haptic control module residing on a steering wheel.

13. The control switch of claim 1, wherein the switch control switch controls wiper functions of the associated vehicle, rotation of the control causing windshield wipers to operate in an intermittent, delay action manner, the windshield wipers having a first delay through the first rotational displacement, the windshield wipers having a second delay through the second rotational displacement.

14. The control switch of claim 13, wherein the rotational displacement of the control corresponds to the period of delay of the wipers, the longer the rotational displacement the shorter the period between actuations of the windshield wiper.

15. A control switch for controlling wiper functions of an associated vehicle comprising:

a control operatively mounted to a vehicle steering column, the control being rotatable to selectively adjust operation of a predetermined function of the windshield wipers of the associated vehicle, the control including at least three rotational displacements having differing lengths, the length of each rotational displacement corresponding to an operation of the windshield wipers; and a selector assembly operatively associated with the control and configured to provide tactile feedback to a driver of the rotation of the control through the differing rotational displacements, wherein the selector assembly includes a fixed member and a rotatable member coupled to the control for rotation therewith, the fixed member including a projection, the rotatable member at least partially defining the rotational displacements and including detents positioned between each rotational displacement, the projection engaging the detents as the control rotates through the rotational displacements.

16. The control switch of claim 15, wherein rotation of the control controls windshield wiper speed, the length of each rotational displacement corresponding to a speed of the windshield wipers, the longer the displacement the faster the speed of the windshield wipers.

17. The control switch of claim 15, wherein rotation of the control causes windshield wipers to operate in an intermittent, delay action manner, the longer the displacement the shorter the period between actuations of the windshield wipers.

18. The control switch of claim 15, wherein the rotatable member includes a first set of the at least three differing rotational displacements and a second set of the at least three differing rotational displacements.

19. A haptic control switch for controlling a windshield wiper of an associated vehicle comprising:

a control operatively mounted to a vehicle steering column, the control being rotatable to selectively adjust operation of the speed of the windshield wipers, the control including a first static member and a second rotatable member wherein at least one of said first static member and said second rotatable member includes detents and the other of said first and second members includes a projection, the projection engaging the detents as the second member rotates, and wherein the detents comprise a first spacing through a first rotational displacement and a second spacing through a second rotational displacement, a length of each spacing corresponding to the speed of the windshield wipers, and wherein the control is configured to provide tactile feedback to a driver of the rotation of the control through the differing spacing lengths.

20. The switch of claim 19, wherein the greater the length of the spacing the faster the speed of the windshield wipers.

21. The switch of claim 19 comprising at least four differing spacing lengths.

* * * * *